US006549013B1

(12) United States Patent
Uhl

(10) Patent No.: US 6,549,013 B1
(45) Date of Patent: Apr. 15, 2003

(54) IONIC CURRENT MEASURING GLOW PLUG AND PROCESS AND CIRCUIT FOR ITS ACTIVATION

(75) Inventor: Günter Uhl, Ludwigsburg (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/618,119

(22) Filed: Jul. 17, 2000

(30) Foreign Application Priority Data

Jul. 26, 1999 (DE) ..... 199 35 025

(51) Int. Cl.[7] ..... F02P 17/00

(52) U.S. Cl. ..... 324/378; 324/459

(58) Field of Search ..... 324/52, 378, 391, 324/652, 402, 459, 460, 464, 465, 468; 123/179.21, 145 A, 145 R; 219/497, 270, 544; 250/551; 361/264, 79–91.5

(56) References Cited

U.S. PATENT DOCUMENTS 4,377,138 A * 3/1983 Mitani ..... 123/179.21
4,469,952 A * 9/1984 Olson ..... 250/551
4,500,775 A * 2/1985 Sangu ..... 219/497
5,349,207 A * 9/1994 Malhi ..... 257/76
5,561,350 A * 10/1996 Frus ..... 315/209 R
5,893,993 A 4/1999 Kurano
5,922,229 A * 7/1999 Kurano ..... 219/270
6,148,660 A * 11/2000 Chiu ..... 73/35.06

FOREIGN PATENT DOCUMENTS

DE 197 37 396 3/1998 ..... 324/378
DE 198 42 148 4/2000
DE 198 52 485 5/2000

OTHER PUBLICATIONS

W. Beits, Dubbel Taschenbuch Für Den Maschinebau. 17th Ed., Springer–Verlag,, Berlin XP002215704, p. 14; Fig. 1.

* cited by examiner

*Primary Examiner*—Kamand Cuneo
*Assistant Examiner*—Trung Nguyen
(74) *Attorney, Agent, or Firm*—Nixon Peabody LLP; David S. Safran

(57) ABSTRACT

Ionic current measurement glow plug with electrical terminal for the glow current of a heating element which is located on the combustion space side in a glow tube, the glow tube being located in a plug housing, insulated relative to the latter, and the plug housing being electrically connected to the engine block (ground), in the terminal-side area of the plug a diode (15) being integrated or modularly located between the glow plug body (4) and the series circuit consisting of a glow tube and a heating element.

4 Claims, 2 Drawing Sheets

IONIC CURRENT MEASURING GLOW PLUG AND PROCESS AND CIRCUIT FOR ITS ACTIVATION

BACKGROUND OF THE INVENTION

1. Field of the Invention

The subject matter of the invention is an ionic current measuring glow plug and process and circuit for its activation.

2. Description of Related Art

Generic glow plugs have a glow tube or an equivalent component in which there is a heating element, the glow tube being insulated relative to the plug housing and the plug housing being electrically connected to the engine block (ground).

A glow plug which is designed for glowing and measurement of the ionic current must be made such that at least in the area of the glow plug tip it represents a measurement electrode to which an auxiliary voltage $U_H$ can be applied. This voltage is then between the electrode and the inside wall of the cylinder. If at this point ions are produced by the combustion process, current flows. Its behavior allows conclusions to be drawn about the combustion process in the cylinder.

Preferably the glow plug is made such that the glow plug tip can be used as an electrode; in this case the heating element and the electrode are electrically interconnected; at the same time the electrode and the heating element are electrically insulated against the glow plug body. These glow plugs conventionally have two electrical terminals with which the glow plug is connected to a control device. The previously described conventional system for glowing and ionic current measurement has several serious defects:

The glow plugs used for ionic current measurement must be connected bipolarly; on the glow plug a new plug-in system is necessary. A corresponding connector must have two heavy current contacts and is thus more expensive than the single pole version.

Plugging a bipolar mating connector onto the engine block-mounted glow plug is more complex than plugging on a rotationally symmetrical connector.

Feedback of the glow plug current to the control device requires a second heavy current line with a large cable cross section with a corresponding plug-and-socket connection on the control device. In this way added costs arise in the control device and due to the additional cable.

The second heavy current line together with the resulting additional contact points increases unwanted contact resistances, reducing the voltage on the glow plug.

In the control device, in addition to the heavy current terminal which is always present in the plus line (current load: total of all glow plug currents) which is usually made as a screw terminal, another heavy current terminal in the minus line is necessary; here added costs arise in installation.

SUMMARY OF THE INVENTION

To overcome these defects the object of the invention consists in making available new glow plugs for glowing and for measurement of the ionic current, and new glow plug control devices and new glow plug control circuits for proper operation of glow plugs with ionic current measurement function.

The invention is explained in detail using the following FIGS. 1 to 4.

DETAILED DESCRIPTION OF THE INVENTION

Figure 1:
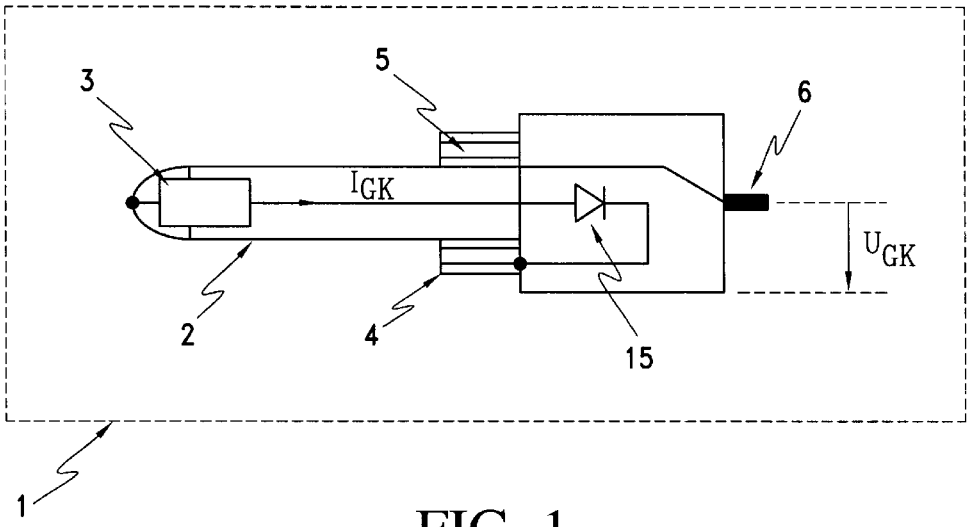
FIG. 1 is a schematic lengthwise section through one embodiment as claimed in the invention of a rod glow plug with an integrated diode control element.

The glow plug 1 in accordance with the invention and as shown in FIG. 1 has a glow tube 2 with the pertinent plug housing 4, the latter being insulated relative to the glow tube 2 by the electrical insulation 5, and in the combustion space-side area of the glow tube 2 the heating element 3 being located.

In the terminal-side area of the glow plug 1 a diode (control element) 15 is integrated. The glow plug is made monopolar with an electrical terminal 6, the voltage $U_{GK}$ lying between the wall of the glow tube 2 and the glow plug housing 4 so that the voltage $U_{GK}$ is on the series connection of the heating element 3 and the diode 15, and the glow tube 2 being connected anywhere to one of the two terminals of the heating element 3; the flow of the glow current $I_{GK}$ is likewise shown schematically.

In the "glow" operating mode the heating element 3 which is electrically connected to the glow tube 2 and which is located in it is connected by its one terminal to the diode 15 which is integrated into the glow plug. The diode in turn is connected via the plug housing 4 and via the engine block (general vehicle ground) to the negative pole of the vehicle electrical system voltage $U_B$. The other terminal of the heating element 3 is switched via the electrical terminal contact 6 of the glow plug 1 and via another switch in the pertinent glow plug control device to the plus pole of the vehicle electrical system voltage $U_B$. Thus the glow circuit is closed.

In the measurement operating mode the integrated electronic diode 15 is disabled so that the glow tube 2 and the heating element 3 have no connection to the engine block and thus to the minus pole. At this point an auxiliary voltage $U_H$ can be placed on the glow tube 2 via the electrical terminal contact 6 of the glow plug 1. In this way an electrical field builds up between the glow tube 2 of the glow plug 1 and the inside cylinder wall which is at ground potential. If ionized gases are formed by combustion in the cylinder, current flows. This ionic current is dependent on the number of generated ions and delivers information about the combustion behavior in the cylinder.

Figure 3:
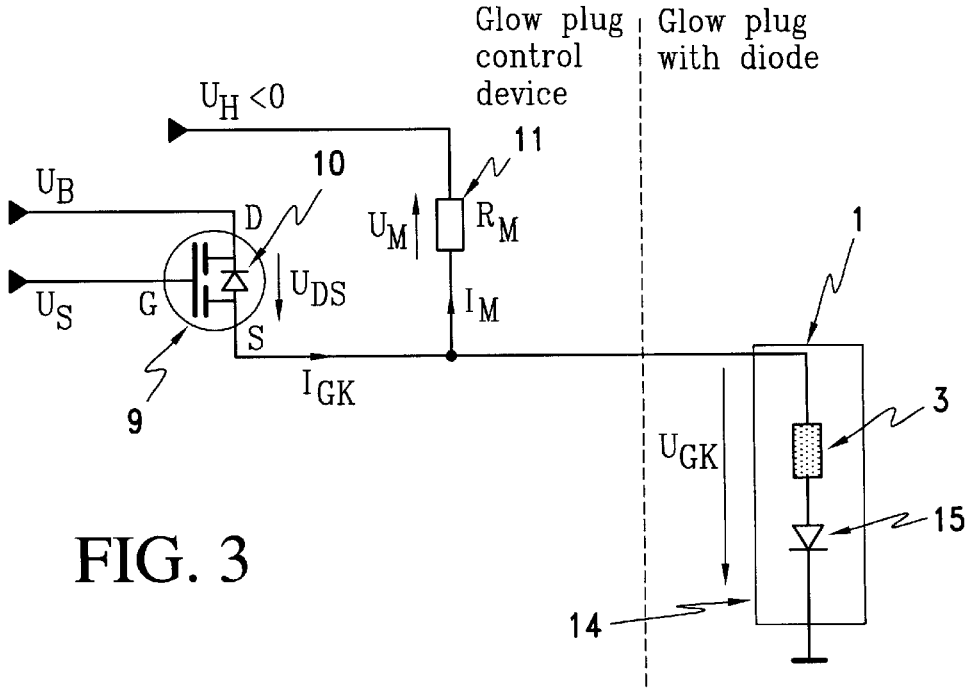
FIG. 3 is a schematic reproduction of an arrangement of the invention including of a glow plug control circuit and glow plug with an integrated diode control element.
Figure 4:
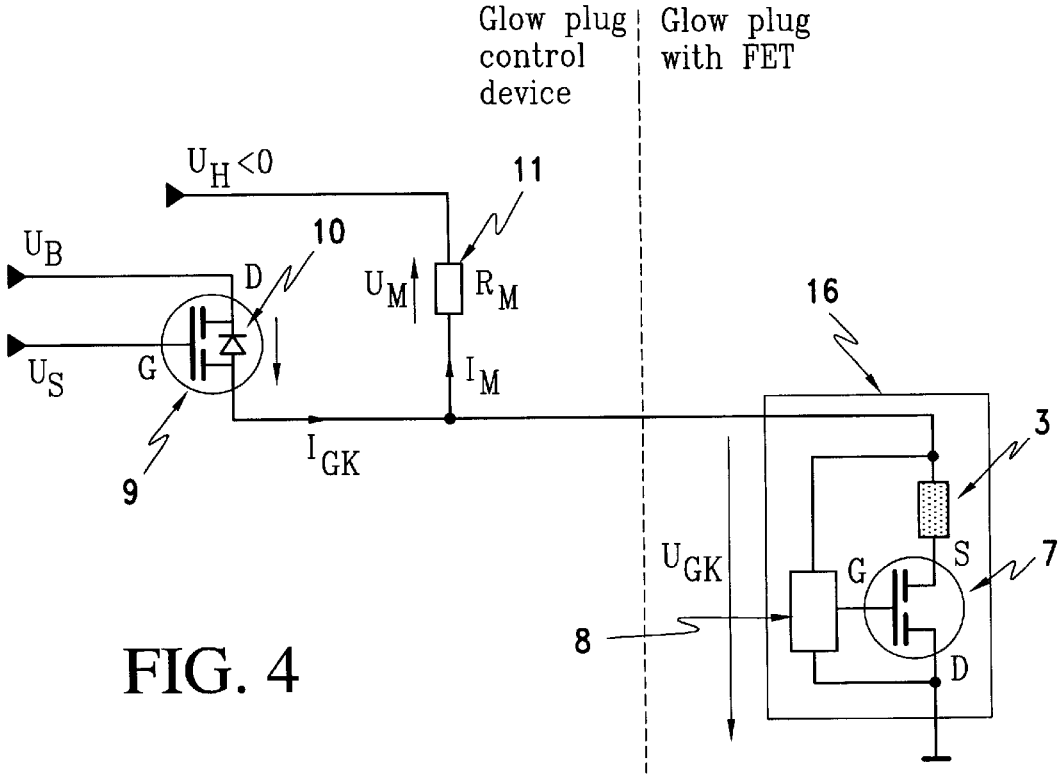
FIG. 4 shows a schematic reproduction of a glow plug control circuit and a glow plug with a MOSFET transistor integrated into it as a semiconductor switch 7 with the pertinent voltage evaluation circuit 8.

The control of the glow plug as shown in FIG. 1 is shown schematically in FIG. 3.

The vehicle electrical system voltage $U_B$ which is necessary for glowing is switched via an electronic switch 9 in the "normal" operating mode to the glow plug 1. The auxiliary voltage $U_H$ is conversely switched with reverse polarity, i.e. negative relative to ground, and thus also relative to the vehicle electrical system voltage $U_B$, via a resistor $R_K$ on the glow plug 1. Via this resistor $R_K$ 11 a voltage $U_H$ which is proportional to the ionic current can be tapped for evaluation of the ionic current signal. In the operating mode "measure" the glow tube and this heating element 19 of the glow plug, i.e. the element which is connected to the glow tube, must be electrically insulated relative to the glow plug housing 4 and the engine block. This can be done in the following two ways:

To decouple the glow tube and the heating element from the glow plug housing 4, through the diode 15 between the glow plug housing 4 and the series circuit consisting of the heating element and the glow tube a direct current flow to ground is possible only at voltage $U_{GK}>0$ V, therefore in the "glow" operating mode when the electronic circuit 9 is switched through. Since the measurement resistance $R_M$ 11 is much larger than the resistance of the series connected glow tube 2 and the heating element 3, the current flow which is established in the measurement circuit can be ignored.

Figure 2:
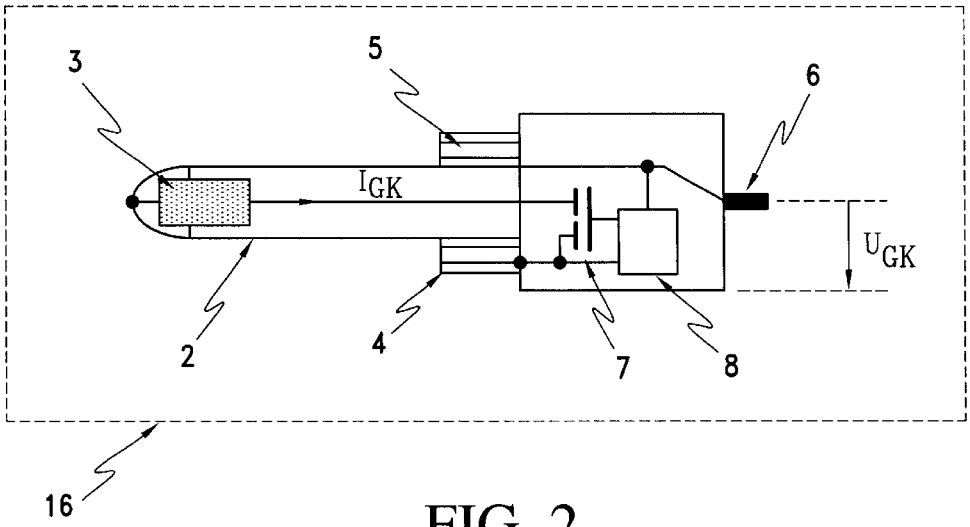
FIG. 2 is a schematic lengthwise section through another embodiment of the invention.

As shown in FIGS. 2/4 it is likewise possible to replace the diode (control element) 15 by a semiconductor switch (control element) 7 which is only tripped using a voltage evaluation circuit 8 when $U_{GK}>0$ V; if its closing resistance is chosen to be correspondingly low, the voltage drop over the electronic switch 7 in the conductive state is very low; the pertinent glow plug is shown schematically in FIG. 2, the reference numbers having the meaning given above.

Other preferred possibilities consist in changing the above described embodiments 1 and 2 such that the voltages $U_B$ and $U_H$ have reversed polarity; this means that the diodes are reversed and the preferably used n-channel MOSFET switches are replaced by p-channel MOSFET switches.

For these solutions it is decisive that the two voltages $U_B$ and $U_H$ have reversed polarity, specifically $$U_B>0\ \text{V}/U_H<0\ \text{V} \quad (1)$$

or $$U_B<0\ \text{V}/U_H>0\ \text{V} \quad (2)$$

The required semiconductor components for the described applications are available or can be built with only little cost; the requirement for the semiconductor components for the functions "glow and measure" are the following relative to the previous function only "glow":

high-side switches 10 with increased reverse voltage $U_{reverse>(UB)}+U_H)$ diode 15 in the glow plug; low leakage current (<1 $\mu$A) in the inhibited state semiconductor switch 7 in the glow plug; reverse voltage $U_{reverse}>U_H$ and low leakage current (<1 $\mu$A) in the inhibited state.

What is claimed is:

1. Ionic current measuring glow plug comprising:

a plug housing electrically grounded to an engine block;

a glow tube located in said plug housing;

a heating element which is located in said glow tube and is electrically insulated relative thereto; and a control element located in a terminal-end area of the plug between the glow plug body and a series circuit comprised of the glow tube and the heating element for making and breaking an electrical connection between the series circuit and the engine block, wherein said control element is a semiconductor switch with a voltage evaluation circuit, the switch being adapted to break said electrical connection by being tripped by the voltage evaluation circuit only when a glow plug voltage $U_{GK}>0$ V, and wherein the glow plug is adapted to operate with a vehicle electrical system voltage $U_B$ for producing glowing of the plug and an auxiliary voltage $U_H$ for producing measurement of ionic current applied with reverse polarity in accordance with one of the relationships:

$$U_B>0\ \text{V}/U_H<0\ \text{V}$$

and $U_B<0$ V/$U_H>0$ V.

2. Glow plug as claimed in claim 1, wherein the semiconductor switch comprises an n-channel MOSFET switch.

3. Glow plug as claimed in claim 1, wherein the semiconductor switch comprises p-channel MOSFET switch.

4. Glow plug according to claim 1, further comprising a control device for activating the glow plug with the voltages $U_B$ and $U_H$ having reverse polarity, so that voltages $U_B$ and $U_H$ meet one of said conditions $U_B>0$ V/$U_H<0$ V and $U_B<0$ v/$U_H>0$ V.

* * * * *